US012031222B2

(12) United States Patent
Xiao et al.

(10) Patent No.: US 12,031,222 B2
(45) Date of Patent: Jul. 9, 2024

(54) SYSTEM AND METHOD FOR CO2 CAPTURE AND ELECTROREGENERATION AND SYNCHRONOUS CONVERSION

(71) Applicant: SOUTHEAST UNIVERSITY, Nanjing (CN)

(72) Inventors: Rui Xiao, Nanjing (CN); Chao Liu, Nanjing (CN); Tao Li, Nanjing (CN); Weicong Xu, Nanjing (CN); Peijun Li, Nanjing (CN); Feng Gong, Nanjing (CN)

(73) Assignee: SOUTHEAST UNIVERSITY, Nanjing (CN)

( * ) Notice: Subject to any disclaimer, the term of this patent is extended or adjusted under 35 U.S.C. 154(b) by 0 days.

(21) Appl. No.: 18/550,629

(22) PCT Filed: Jan. 4, 2023

(86) PCT No.: PCT/CN2023/070328
§ 371 (c)(1),
(2) Date: Sep. 14, 2023

(87) PCT Pub. No.: WO2023/160261
PCT Pub. Date: Aug. 31, 2023

(65) Prior Publication Data

US 2024/0084463 A1 Mar. 14, 2024

(30) Foreign Application Priority Data

Feb. 25, 2022 (CN) ..... 202210184705.8

(51) Int. Cl.
*C25B 3/26* (2021.01)
*C25B 15/08* (2006.01)

(52) U.S. Cl.
CPC ..... *C25B 3/26* (2021.01); *C25B 15/087* (2021.01)

(58) Field of Classification Search
CPC ..... C25B 3/26; C25B 9/21; C25B 15/087
See application file for complete search history.

(56) References Cited

U.S. PATENT DOCUMENTS 3,511,712 A 5/1970 Giner
2012/0048730 A1* 3/2012 Hartvigsen ..... C25B 1/02 204/278
2012/0240764 A1 9/2012 Kim et al.

FOREIGN PATENT DOCUMENTS

CN 1658425 A 8/2005
CN 101392386 A 3/2009
(Continued)

*Primary Examiner* — Ciel P Contreras
(74) *Attorney, Agent, or Firm* — MUNCY, GEISSLER, OLDS & LOWE, PC

(57) ABSTRACT

A system and method for $CO_2$ capture and electroregeneration and synchronous conversion are provided. The system includes a $CO_2$ capture subsystem, which uses an absorption liquid to capture $CO_2$ and generate a capture liquid; and a $CO_2$ electroregeneration and synchronous conversion subsystem, including a cathode chamber provided with a cathode electrode, a sample inlet, and a sample outlet, an anode chamber having an anode electrode, a sample inlet connected to an outlet of the capture liquid of the $CO_2$ capture subsystem, and a sample outlet connected to the sample inlet of the cathode chamber for introducing $CO_2$ regenerated by anodic oxidation into the cathode chamber for electroreduction, and a balance chamber in the middle having a sample outlet connected to an inlet of the absorption liquid of the $CO_2$ capture subsystem. The system can perform self-circulation and stably operate, to capture, regenerate and convert $CO_2$.

7 Claims, 1 Drawing Sheet

(56) References Cited

FOREIGN PATENT DOCUMENTS

| | | | |
|---|---|---|---|
| CN | 102240497 | A | 11/2011 |
| CN | 103191633 | A | 7/2013 |
| CN | 204710062 | U | 10/2015 |
| CN | 105297067 | A | 2/2016 |
| CN | 105617842 | A | 6/2016 |
| CN | 110914477 | A | 3/2020 |
| CN | 110914478 | A | 3/2020 |
| CN | 110983357 | A | 4/2020 |
| CN | 111924807 | A | 11/2020 |
| CN | 112499651 | A | 3/2021 |
| CN | 113549929 | A | 10/2021 |
| CN | 113913851 | A | 1/2022 |
| CN | 114000172 | A | 2/2022 |
| CN | 114645290 | A | 6/2022 |
| DE | 1 953 563 | A1 | 5/1970 |
| GB | 1 261 287 | A | 1/1972 |
| JP | H04-290526 | A | 10/1992 |
| WO | WO-2020/016012 | A1 | 1/2020 |

* cited by examiner

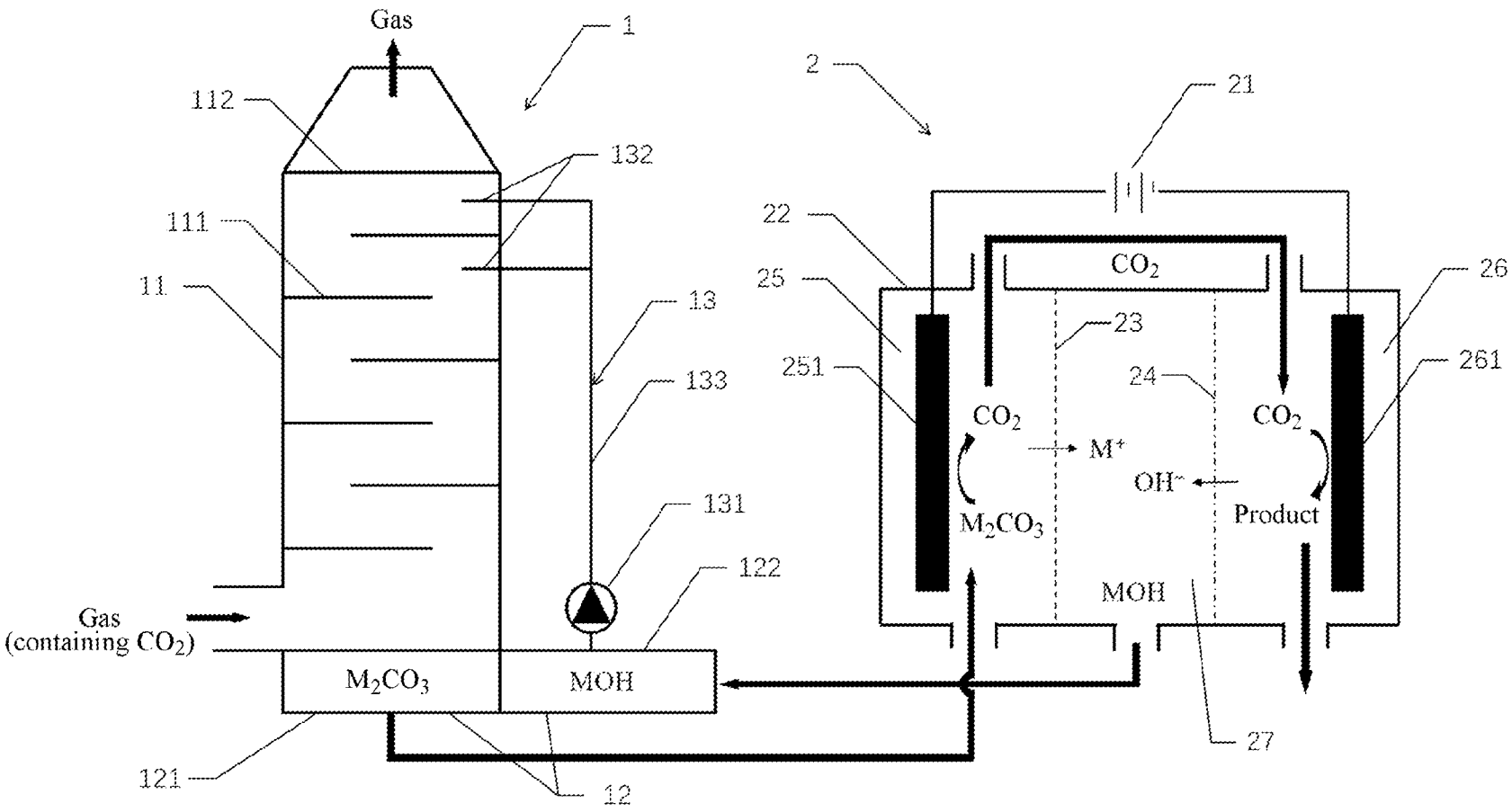
26
261
21
$CO_2$
Product
27
24
$OH^-$
$CO_2$
23
$M^+$
MOH
$CO_2$
$M_2CO_3$
2
22
25
251
122
131
13
133
1
132
MOH
12
Gas
$M_2CO_3$
112
111
11
Gas
(containing $CO_2$)
121

SYSTEM AND METHOD FOR CO2 CAPTURE AND ELECTROREGENERATION AND SYNCHRONOUS CONVERSION

TECHNICAL FIELD

The present disclosure relates to the field of $CO_2$ capture and utilization, and particularly relates to a system and method for $CO_2$ capture and electroregeneration and synchronous conversion.

BACKGROUND $CO_2$ capture, utilization and storage (CCUS) is an important strategic choice to achieve the goal of emission peak and carbon neutrality, and the technology has made great progress under the promotion of relevant policies. $CO_2$ capture can be divided into two categories: amine adsorption and alkali liquor absorption. Solid amine adsorbents (MEA, DEA, TEA, PEI, etc.) are the most popular adsorbent materials at present, which employ porous-based materials with high specific surface areas as carriers to strengthen the contact between the adsorbent and $CO_2$, showing good $CO_2$ adsorption selectivity and large-scale application potential. However, because of the limitation caused by the high cost of the amine adsorbent materials and the mass transfer of the porous materials, the total processing capacity of the system is small, and cyclic adsorption-desorption will also accelerate the degradation of the performance of solid amine materials. $CO_2$ capture by alkali liquor absorption has significant cost advantages while $CO_2$ can be removed to a high extent. The whole process can continue for a long time, and mature equipment such as a contact tower can be used.

$CO_2$ storage is one of the initiatives to achieve $CO_2$ reduction, and mainly includes two categories of oil-displacement storage and geological storage. However, with the limitation of the geological structure, captured $CO_2$ cannot be flexibly stored locally, and the subsequent transportation process will incur additional costs. Therefore, local conversion and utilization of $CO_2$ can significantly reduce the transportation cost and fundamentally eliminate $CO_2$, so as to achieve the $CO_2$ reduction and resource utilization. Among various methods of $CO_2$ conversion, electrochemical conversion can activate $CO_2$ at a low energy input, quickly stabilize $CO_2$ intermediates with simultaneous electron/proton transfer, and realize the oriented conversion of $CO_2$ to generate high value-added terminal products relying on the active centers with precise structures and structurally adjustable catalysts. Compared with the thermochemical method for $CO_2$ conversion, which requires severe conditions such as high temperature and high pressure, the electrochemical $CO_2$ conversion has mild reaction conditions, low energy consumption and no need for additional hydrogen source.

$CO_2$ after being absorbed by an alkali liquor can be also regenerated by an electrochemical reaction, with the energy consumption much lower than that of $CO_2$ thermal regeneration, and the alkali liquor absorbent can be regenerated simultaneously, with an obvious advantage. However, limited by the reactor structure and system operation, the electroregeneration study and electroconversion study on $CO_2$ after being absorbed by the alkali liquor are carried out separately in the prior art, i.e., the electroregeneration of $CO_2$ and the electroconversion of $CO_2$ are investigated separately in different reactors, which leads to the doubled consumption of electrical energy and the complexity of the reaction system.

SUMMARY

For the defects in the prior art, the present disclosure provides a system and method for $CO_2$ capture and electroregeneration and synchronous conversion, in order to achieve the coupling treatment of $CO_2$ capture, absorption liquid recycling, $CO_2$ regeneration and conversion into high value-added products, thus reducing the system energy consumption.

The technical solution adopted by the present disclosure is as follows.

A system for $CO_2$ capture and electroregeneration and synchronous conversion includes a $CO_2$ capture subsystem and a $CO_2$ electroregeneration and synchronous conversion subsystem.

The $CO_2$ capture subsystem uses an absorption liquid to capture $CO_2$ and generate a capture liquid.

The $CO_2$ electroregeneration and synchronous conversion subsystem includes an electrolytic cell; a cation exchange membrane and an anion exchange membrane are arranged in the electrolytic cell at an interval, and the cation exchange membrane and the anion exchange membrane separate the electrolytic cell into an anode chamber and a cathode chamber at the left and right ends, and a balance chamber in the middle.

An anode electrode is arranged in the anode chamber, the anode chamber is further provided with a sample inlet and a sample outlet; a cathode electrode is arranged in the cathode chamber, and the cathode chamber is further provided with a sample inlet and a sample outlet; the balance chamber is provided with a sample outlet.

The sample inlet of the anode chamber is connected to an outlet of the capture liquid of the $CO_2$ capture subsystem, and the sample outlet of the anode chamber is connected to the sample inlet of the cathode chamber for introducing $CO_2$ regenerated by anodic oxidation into the cathode chamber for electroreduction; and the sample outlet of the balance chamber is connected to an inlet of the absorption liquid of the $CO_2$ capture subsystem.

According to a further technical solution,

- the anode electrode is an inert electrode, and the cathode electrode is provided with a catalyst catalyzing $CO_2$ to have an electroreduction reaction.

The $CO_2$ electroregeneration and synchronous conversion subsystem further includes a power supply, and the anode electrode and the cathode electrode are connected to the two ends of the power supply respectively.

The structure of the $CO_2$ capture subsystem includes a spray tower, a liquid storage tank and a spray device;

- the spray tower is provided with a gas inlet, a gas outlet, tower plates and a demister;
- the liquid storage tank includes a liquid storage tank body A and a liquid storage tank body B; the liquid storage tank body A receives the capture liquid at the bottom of the spray tower and is connected to the sample inlet of the anode chamber; the liquid storage tank body B stores the fresh alkali absorption liquid and is connected to the sample outlet of the balance chamber;
- the spray device includes a pump, a spray head and pipelines; the spray head is connected to the liquid storage tank body B through the pipelines, and the pump is arranged on the pipelines.

A method for $CO_2$ capture and electroregeneration and synchronous conversion of the system for $CO_2$ capture and electroregeneration and synchronous conversion includes:

introducing the gas containing $CO_2$ into the $CO_2$ capture subsystem 1 and capturing the $CO_2$ by means of an absorption liquid to generate a capture liquid;

introducing the capture liquid into the anode chamber of the $CO_2$ electroregeneration and synchronous conversion subsystem, using the capture liquid as an anode electrolyte of the anode chamber, and enabling carbonate ions $CO_3^{2-}$ in the capture liquid to be regenerated into $CO_2$ by electrooxidation while generating cations, the cations entering the balance chamber through the cation exchange membrane;

introducing the regenerated $CO_2$ into the cathode chamber for electroreduction to generate high value-added products while consuming protons $H^+$ in the solution to increase the concentration of hydroxide ions $OH^-$, the hydroxide ions $OH^-$ entering the balance chamber through the anion exchange membrane;

regenerating the hydroxide ions $OH^-$ and the cations in the balance chamber into a new absorption liquid; and introducing the regenerated new absorption liquid into the $CO_2$ capture subsystem for capturing $CO_2$, forming a cycle of $CO_2$ capture, electroregeneration and synchronous conversion.

According to a further technical solution, the method for $CO_2$ capture and electroregeneration and synchronous conversion further includes:

discharging the high value-added products through the sample outlet of the cathode chamber.

The method for $CO_2$ capture and electroregeneration and synchronous conversion further includes:

the cathode electrode being provided with a catalyst for $CO_2$ electroreduction, achieving the oriented preparation of different high value-added products, such as CO, methane, methanol, formic acid, ethanol, acetic acid or propanol, from $CO_2$ by changing the type of the catalyst.

The present disclosure has the beneficial effects as follows:

(1) In the present disclosure, the $CO_2$ capture subsystem and the $CO_2$ electroregeneration and synchronous conversion subsystem are organically connected in series through the absorption liquid and the capture liquid, in which the $CO_2$ capture by the absorption liquid, the electroregeneration of the capture liquid, and the backflow of the regenerated absorption liquid are regulated and controlled, so that $CO_2$ can be captured, regenerated and synchronously converted into high value-added products, and the efficient and stable operation of the system is realized. Compared with the existing treatment solution, the structure of the system is optimized and the energy consumption of the system is greatly reduced.

(2) The liquid storage tank of the $CO_2$ capture subsystem of the present disclosure is divided into two parts of A and B, and the capture liquid after $CO_2$ capture and the fresh absorption liquid after electroregeneration are placed in different regions, so that only the fresh absorption liquid is sprayed for $CO_2$ capture, which has a large concentration gradient, small mass transfer resistance, fast absorption rate and high capture efficiency; so only the capture liquid after $CO_2$ capture, which is high in concentration of carbonate $CO_3^{2-}$ and undiluted, flows into the $CO_2$ electroregeneration and synchronous conversion subsystem, which can avoid the occurrence of ineffective electrooxidation and improve the utilization efficiency of electric energy.

(3) The present disclosure couples the traditional alkali $CO_2$ capture liquid electroregeneration system, which only uses the anode half-reaction, with the traditional $CO_2$ electroreduction system, which only uses the cathode half-reaction. By designing and optimizing the structure of the reactor, and regulating and controlling the charge and material balance, a novel two-level membrane electroreaction system for $CO_2$ electroregeneration and synchronous conversion is constructed to simultaneously use the cathode and the anode, which greatly improves the reaction efficiency, and at least reduces 50% of the required electric energy.

(4) By changing the cathode catalyst, $CO_2$ can be orientedly prepared into different high value-added products such as CO, methane, methanol, formic acid, ethanol, acetic acid and propanol.

BRIEF DESCRIPTION OF THE DRAWINGS

The FIGURE is a structural schematic diagram of a system according to an embodiment of the present disclosure.

In the FIGURE: 1, $CO_2$ capture subsystem; 11, spray tower; 111, tower plate; 112, demister; 12, liquid storage tank; 121, liquid storage tank body A; 122, liquid storage tank body B; 13, spray device; 131, pump; 132, spray head; 133, pipeline; 2, $CO_2$ electroregeneration and synchronous conversion subsystem; 21, power supply; 22, electrolytic cell; 23, cation exchange membrane; 24, anion exchange membrane; 25, anode chamber; 251, anode electrode; 26, cathode chamber; 261, cathode electrode; and 27, balance chamber.

DETAILED DESCRIPTION

Implementations of the present disclosure will be described below in combination with the accompanying drawing.

As shown in the FIGURE, a system for $CO_2$ capture and electroregeneration and synchronous conversion of the present application includes a $CO_2$ capture subsystem 1 and a $CO_2$ electroregeneration and synchronous conversion subsystem 2.

The $CO_2$ capture subsystem 1 uses an absorption liquid to capture $CO_2$ and generate a capture liquid.

The $CO_2$ electroregeneration and synchronous conversion subsystem 2 includes an electrolytic cell 22; a cation exchange membrane 23 and an anion exchange membrane 24 are arranged in the electrolytic cell 22 at an interval, and the cation exchange membrane 23 and the anion exchange membrane 24 separate the electrolytic cell 22 into an anode chamber 25 and a cathode chamber 26 at the left and right ends, and a balance chamber 27 in the middle.

An anode electrode 251 and an anode electrolyte are arranged in the anode chamber 25, and the anode chamber 25 is further provided with a sample inlet and a sample outlet.

A cathode electrode 261 and a cathode electrolyte are arranged in the cathode chamber 26, the cathode electrolyte is an electrolyte required for an electroreduction reaction of $CO_2$; the cathode chamber 26 is further provided with a sample inlet and a sample outlet;

and the balance chamber 27 is provided with a sample outlet.

The sample inlet of the anode chamber 25 is connected to an outlet of the capture liquid of the $CO_2$ capture subsystem 1, for using the capture liquid as the anode electrolyte.

The sample outlet of the anode chamber 25 is connected to the sample inlet of the cathode chamber 26, for introducing $CO_2$ regenerated by anodic oxidation into the cathode chamber 26 for reduction.

The sample outlet of the balance chamber 27 is connected to an inlet of the absorption liquid of the $CO_2$ capture subsystem 1, for supplementing an absorption liquid to the $CO_2$ capture subsystem 1.

Specifically, the anode electrode 251 is an inert electrode, and the cathode electrode 261 is provided with a catalyst catalyzing $CO_2$ to have an electroreduction reaction.

Specifically, the cathode electrolyte is one of a $KHCO_3$ solution or a KCl solution with a concentration of 0.1 to 1 mol/L.

Specifically, the anion exchange membrane 24 is a hydroxide ion exchange membrane.

Specifically, the sample outlet of the anode chamber 25 and the sample inlet of the cathode chamber 26 are connected by an external channel, allowing the electroregenerated $CO_2$ to enter the cathode chamber 26 for reduction.

Specifically, the $CO_2$ electroregeneration and synchronous conversion subsystem 2 further includes a power supply 21, and the anode electrode 251 and the cathode electrode 261 are connected to the two ends of the power supply 21 respectively.

Specifically, the structure of the $CO_2$ capture subsystem 1 includes a spray tower 11, a liquid storage tank 12 and a spray device 13.

Specifically, the spray tower 11 is provided with a gas inlet, a gas outlet, tower plates 111 and a demister 112; the tower plates 111 are staggered to increase the contact area of a spray liquid and $CO_2$.

Specifically, the liquid storage tank 12 includes a liquid storage tank body A 121 and a liquid storage tank body B 122;

the liquid storage tank body A 121 receives the capture liquid at the bottom of the spray tower 11 and is connected to the sample inlet of the anode chamber 25; the fresh alkali absorption liquid is in the liquid storage tank body B 122 and is connected to the sample outlet of the balance chamber 27.

The spray device 13 includes a pump 131, a spray head 132 and pipelines 133;

the spray head 132 is connected to the liquid storage tank body B 122 through the pipelines 133, and the pump 131 is arranged on the pipelines 133.

According to the system for $CO_2$ capture and electroregeneration and synchronous conversion, the $CO_2$ capture liquid generated by the $CO_2$ capture subsystem 1 flows into the $CO_2$ electroregeneration and synchronous conversion subsystem 2, and the absorption liquid regenerated by the $CO_2$ electroregeneration and synchronous conversion subsystem 2 flows back to the $CO_2$ capture subsystem 1, so that the $CO_2$ capture subsystem 1 and the $CO_2$ electroregeneration and synchronous conversion subsystem 2 are organically connected in series, achieving $CO_2$ capture, regeneration and synchronous conversion, which enables the overall system to operate stably.

A method for $CO_2$ capture and electroregeneration and synchronous conversion of the system for $CO_2$ capture and electroregeneration and synchronous conversion of the present application includes:

introducing the gas containing $CO_2$ into the $CO_2$ capture subsystem 1 and capturing $CO_2$ by means of an absorption liquid to generate a capture liquid;

introducing the capture liquid into the anode chamber 25 of the $CO_2$ electroregeneration and synchronous conversion subsystem 2, using the capture liquid as an anode electrolyte of the anode chamber 25, and enabling carbonate ions $CO_3^{2-}$ in the capture liquid to be regenerated into $CO_2$ by electrooxidation while generating cations, the cations entering the balance chamber 27 through the cation exchange membrane 23;

introducing the regenerated $CO_2$ into the cathode chamber 26 for electroreduction to generate high value-added products while consuming protons $H^+$ in the solution to increase the concentration of hydroxide ions $OH^-$, the hydroxide ions $OH^-$ entering the balance chamber 27 through the anion exchange membrane 24;

regenerating the hydroxide ions $OH^-$ and the cations in the balance chamber 27 into a new absorption liquid; and introducing the regenerated new absorption liquid into the $CO_2$ capture subsystem 1 for capturing $CO_2$, forming a cycle of $CO_2$ capture, electroregeneration and synchronous conversion.

The method for $CO_2$ capture and electroregeneration and synchronous conversion further includes:

discharging the high value-added products through the sample outlet of the cathode chamber 26.

The method for $CO_2$ capture and electroregeneration and synchronous conversion further includes:

the cathode electrode 261 being provided with a catalyst for $CO_2$ electroreduction, achieving the oriented preparation of different high value-added products, such as CO, methane, methanol, formic acid, ethanol, acetic acid or propanol, from $CO_2$ by changing the type of the catalyst.

As an implementation, the above method for $CO_2$ capture and electroregeneration and synchronous conversion, as shown in the FIGURE, includes as follows:

the gas containing $CO_2$ is introduced from the gas inlet at the bottom of the spray tower 11 of the $CO_2$ capture subsystem 1, and the spray device 13 pumps the fresh $CO_2$ absorption liquid in the liquid storage tank body B 122 to the top of the spray tower 11 for spraying, with the gas flowing from bottom to top and the absorption liquid flowing from top to bottom; the capture liquid after capturing $CO_2$ flows into the liquid storage tank body A 121, and the gas is discharged from the gas outlet after being de-watered by the demister 112;

the $CO_2$ capture liquid stored in the liquid storage tank body A 121 is introduced to the sample inlet of the anode chamber 25 of the $CO_2$ electroregeneration and synchronous conversion subsystem 2, and the carbonate ions $CO_3^{2-}$ in the $CO_2$ capture liquid is electrooxidized to generate $CO_2$, which then flows out from the sample outlet of the anode chamber 25 and flows to the sample inlet of the cathode chamber 26 through an external channel; cations in the anode chamber 25 enter the balance chamber 27 through the cation exchange membrane 23 under the effect of the concentration difference;

$CO_2$ entering from the sample inlet of the cathode chamber 26 through the external channel undergoes an electroreduction reaction under the action of the catalyst in the cathode electrode 261 to produce high-value products; hydrogen ions $H^+$ in the solution are consumed simultaneously in the electroreduction process of $CO_2$, and the concentration of hydroxide ions $OH^-$ in the cathode chamber 26 gradually increases, which enter the balance chamber 27 through the anion exchange membrane 24 under the action of the concentration difference;

the cations ($M^+$ ions as shown in the FIGURE) entering the balance chamber 27 from the anode chamber 25 through the cation exchange membrane 23 and the hydroxide ions $OH^-$ entering the balance chamber 27 from the cathode chamber 26 through the anion exchange membrane 24 are regenerated into a fresh $CO_2$ absorption liquid (MOH as shown in the FIGURE) in the balance chamber 27 of the $CO_2$ electroregeneration and synchronous conversion subsystem 2, which flows back to the liquid storage tank body B 122 of the $CO_2$ capture subsystem 1, realizing the balanced and stable operation of the system for $CO_2$ capture and electroregeneration and synchronous conversion.

It can be understood by those skilled in the art that: the above description is only preferred embodiments of the present disclosure and is not intended to limit the present disclosure. Although the present disclosure is described in detail with reference to the foregoing embodiments, a person skilled in the art can still make modifications to the technical solutions described in the foregoing embodiments, or make equivalent replacements to some of the technical features. Any modifications, equivalent replacements and improvements made within the spirit and principles of the present disclosure shall be included within the protection scope of the present disclosure.

What is claimed is:

1. A system for $CO_2$ capture and electroregeneration and synchronous conversion, comprising: a $CO_2$ capture subsystem and a $CO_2$ electroregeneration and synchronous conversion subsystem;

wherein the $CO_2$ capture subsystem uses an absorption liquid to capture $CO_2$ and generate a capture liquid;

the $CO_2$ electroregeneration and synchronous conversion subsystem comprises an electrolytic cell; a cation exchange membrane and an anion exchange membrane are arranged in the electrolytic cell at an interval, the cation exchange membrane and the anion exchange membrane separate the electrolytic cell into an anode chamber and a cathode chamber at the left and right ends, and a balance chamber in the middle;

an anode electrode is arranged in the anode chamber, the anode chamber is further provided with a sample inlet and a sample outlet; a cathode electrode is arranged in the cathode chamber, and the cathode chamber is further provided with a sample inlet and a sample outlet; the balance chamber is provided with a sample outlet; and the sample inlet of the anode chamber is connected to an outlet of the capture liquid of the $CO_2$ capture subsystem, and the sample outlet of the anode chamber is connected to the sample inlet of the cathode chamber for introducing $CO_2$ regenerated by anodic oxidation into the cathode chamber for electroreduction; and the sample outlet of the balance chamber is connected to an inlet of the absorption liquid of the $CO_2$ capture subsystem.

2. The system for $CO_2$ capture and electroregeneration and synchronous conversion according to claim 1, wherein the anode electrode is an inert electrode, and the cathode electrode is provided with a catalyst catalyzing $CO_2$ to have an electroreduction reaction.

3. The system for $CO_2$ capture and electroregeneration and synchronous conversion according to claim 1, wherein the $CO_2$ electroregeneration and synchronous conversion subsystem further comprises a power supply, and the anode electrode and the cathode electrode are connected to two ends of the power supply respectively.

4. The system for $CO_2$ capture and electroregeneration and synchronous conversion according to claim 1, wherein the $CO_2$ capture subsystem comprises a spray tower, a liquid storage tank and a spray device;

the spray tower is provided with a gas inlet, a gas outlet, tower plates and a demister;

the liquid storage tank comprises a liquid storage tank body A and a liquid storage tank body B; the liquid storage tank body A receives the capture liquid at a bottom of the spray tower and is connected to the sample inlet of the anode chamber; the liquid storage tank body B stores fresh alkali absorption liquid and is connected to the sample outlet of the balance chamber; and the spray device comprises a pump, a spray head and pipelines; and the spray head is connected to the liquid storage tank body B through the pipelines, and the pump is arranged on the pipelines.

5. A method for $CO_2$ capture and electroregeneration and synchronous conversion of the system for $CO_2$ capture and electroregeneration and synchronous conversion according to claim 1, comprising:

introducing a gas containing $CO_2$ into the $CO_2$ capture subsystem and capturing $CO_2$ by means of the absorption liquid to generate the capture liquid;

introducing the capture liquid into the anode chamber of the $CO_2$ electroregeneration and synchronous conversion subsystem, using the capture liquid as an anode electrolyte of the anode chamber, and enabling carbonate ions $CO_3^{2-}$ in the capture liquid to be regenerated into $CO_2$ by electrooxidation while generating cations, the cations entering the balance chamber through the cation exchange membrane;

introducing the regenerated $CO_2$ into the cathode chamber for electroreduction to generate high value-added products while consuming protons $H^+$ to increase a concentration of hydroxide ions $OH^-$, the hydroxide ions $OH^-$ entering the balance chamber through the anion exchange membrane;

regenerating the hydroxide ions $OH^-$ and the cations in the balance chamber into a new absorption liquid; and introducing the regenerated new absorption liquid into the $CO_2$ capture subsystem for capturing $CO_2$, forming a cycle of $CO_2$ capture, electroregeneration and synchronous conversion.

6. The method for $CO_2$ capture and electroregeneration and synchronous conversion according to claim 5, further comprising:

discharging the high value-added products through the sample outlet of the cathode chamber.

7. The method for $CO_2$ capture and electroregeneration and synchronous conversion according to claim 5, further comprising:

providing the cathode electrode with a catalyst for $CO_2$ electroreduction, achieving oriented preparation of different high value-added products from $CO_2$ by changing the catalyst, wherein the value-added product is CO, methane, methanol, formic acid, ethanol, acetic acid or propanol.

* * * * *